United States Patent [19]

Eggleston

[11] Patent Number: 4,985,599

[45] Date of Patent: Jan. 15, 1991

[54] TRANSFORMER BUSHING CAP

[76] Inventor: Robert E. Eggleston, Rt. 1, Box 909, Manteo, N.C. 27954

[21] Appl. No.: 259,303

[22] Filed: Oct. 18, 1988

[51] Int. Cl.[5] ..... H01B 17/00

[52] U.S. Cl. ..... 174/138 F; 174/5 R; 336/65; 336/90

[58] Field of Search ..... 361/117, 127, 132; 174/142, 144, 152 R, 167, 5, 139, 138 F, 145, 80

[56] References Cited

U.S. PATENT DOCUMENTS

| | | | |
|---|---|---|---|
| 1,291,218 | 1/1919 | Sonneborn | 361/122 X |
| 1,394,971 | 10/1921 | Creighton et al. | 361/132 |
| 2,021,912 | 11/1935 | Edmonds . | |
| 2,234,662 | 3/1941 | Aime | 175/5 R |
| 2,284,530 | 5/1942 | Meyer . | |
| 2,597,596 | 5/1952 | Reid . | |
| 2,809,228 | 10/1957 | Dutton . | |
| 3,054,975 | 9/1962 | Barr . | |
| 3,238,291 | 3/1966 | Bosch et al. | 175/138 F |
| 3,274,526 | 9/1966 | Emanuelson | 336/60 |
| 3,629,758 | 12/1971 | Pearce, Jr. | 336/57 |
| 3,644,858 | 2/1972 | Galloway | 336/92 |
| 3,875,466 | 4/1975 | Jakszt | 361/127 X |
| 4,161,012 | 7/1979 | Cunningham | 361/127 X |
| 4,448,444 | 5/1984 | Toussaint | 361/331 |
| 4,492,817 | 1/1985 | Selby | 174/152 R |
| 4,510,477 | 4/1985 | Rostron et al. | 336/91 |
| 4,542,363 | 9/1985 | Kato et al. | 361/132 X |

*Primary Examiner*—Derek S. Jennings

*Attorney, Agent, or Firm*—Cushman, Darby & Cushman

[57] ABSTRACT

A bushing cap is provided for mounting to a transformer bushing or to a lightening arrestor. The bushing cap when mounted to the bushing acts as an umbrella for the bushing to protect the same from airborne contaminates such as salt spray which can form a conductive surface on the bushing, while providing adequate bottom and side clearance from the bushing to ensure that a conductive surface between the cap and the bushing is avoided.

7 Claims, 4 Drawing Sheets

TRANSFORMER BUSHING CAP

BACKGROUND OF THE INVENTION

1. Field of the Invention

The present invention relates to transformers and, more particularly, to a cap for a transformer bushing for isolating the energized end of the same from air borne contaminants.

2. Description of the Related Art

High power electrical transformers are conventionally enclosed within a hermitically sealed, grounded metallic tank. Bushings are inserted through the top of the casing and sealed to the top of the insulating casing. One or more such bushings, either high voltage or low voltage, are installed as necessary to make the desired electrical connections to the high and low voltage windings of the coil assemblies of the transformer. The bushings provide a conductive path for the current through an opening in the metallic container of the transformer which is itself properly sealed to prevent entry therein of the moisture, gases, or dust particles. Thus, the insulating material, for example rigid porcelain, surrounds the electrical conductor. This provides the electrical conductor with lateral support and protects against electrical contact with other conductive elements such as the metallic tank. The energized end, spaced from the metallic tank, is then coupled to a cable or other conductor.

It has been found that the foregoing structure is disadvantageous in that the energized end of the porcelain bushing is not isolated from airborne contaminants and particularly salt spray where the transformer is disposed along the coast and exposed to salt water entrained in coastal breezes. When conductive salt spray contaminants in the air land on the porcelain bushing, they ultimately form a conductive surface which causes phase to ground faults resulting in power outages. Similar problems are encountered with the porcelain bushings of lighting arrestors.

It would, therefore, be desirable to provide a means for protecting the porcelain bushing from salt spray and like contaminants in the air and thus prevent the creation of a conductive surface on the porcelain.

SUMMARY OF THE INVENTION

The present invention provides a means for protecting the porcelain bushing of a transformer or of a lightening arrestor from the accumulation of conductive salt spray thereon and thus prevent the formation of a bridging type of conductive surface on these structures.

The present invention includes a bushing cap for a transformer or lighting arrestor which acts as an umbrella for the porcelain bushing while enabling adequate bottom clearance and a clearance gap from the bushing and thus protects the same from salt spray contaminants and the like which can form a conductive surface thereon. The cap includes a cap element which has a closed end and an open end and a mounting aperture defined through the closed end thereof. A stem element is further provided and has a first end which can be coupled to the exposed end of the electrical conductor encased in the insulative bushing. The other end of the stem is inserted through the mounting aperture of the cap so that cap surrounds a portion of the length of the bushing and is spaced radially therefrom along that length.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein life reference numerals designated corresponding parts in the various figures.

DETAILED DESCRIPTION OF THE PRESENTLY PREFERRED EXEMPLARY EMBODIMENT

Figure 1:
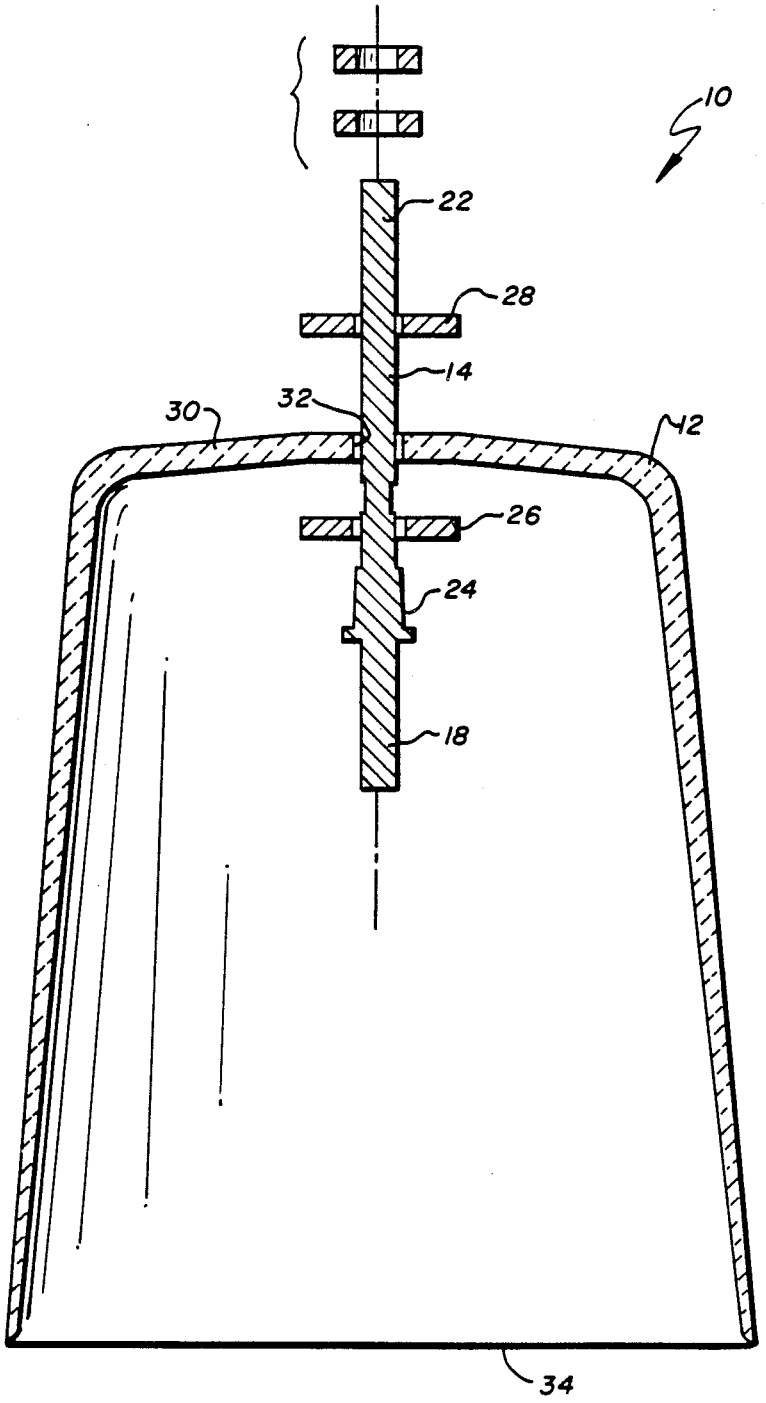
FIG. 1 is an exploded view of a bushing cap and stem for a transformer bushing formed in accordance with the present invention.

Referring to FIG. 1, the bushing cap 10 of the present invention includes a cap element 12 and a stem 14 for coupling to the energized end of a transformer bushing 16. The stem 14 is formed from a conductive material so that, once one end 18 is mounted to the energized end 20 of the transformer bushing 16, the opposite end 22 of the cap stem 14 can be coupled to a further cable or conductor. The stem 14 has a collar 24 with a flange defined along the length thereof for supporting the cap 12 in spaced relation from the bushing 16. First and second metal or ceramic disks or washers 26,28 are also provided. The disks 26,28 facilitate the suspending coupling of cap 12 to stem 14 by providing a seat for bushing cap 12 as will become more apparent below.

As can be seen the cap 12 is in the form of a truncated cone having a closed end 30 having a mounting aperture 32 defined therethrough and an open end 34 which is slidably mounted over the stem 14. Further, the cap may be formed from any suitable non conductive, weather resistant material including but not limited to ceramic or a rigid plastic.

Figure 2:
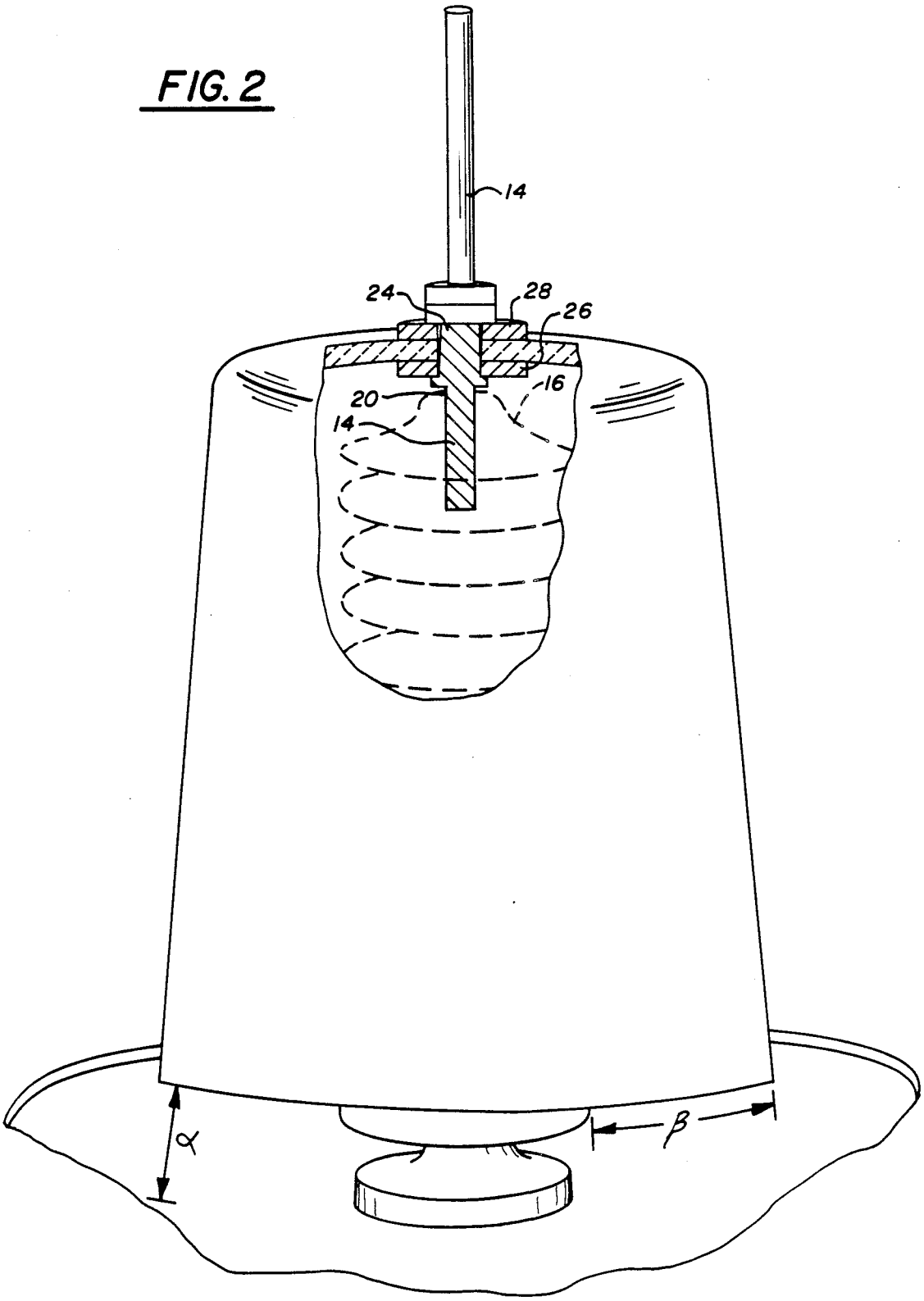
FIG. 2 is a schematic side elevational view showing a bushing cap formed in accordance with the present invention mounted to a transformer bushing.

Referring to FIGS. 1 and 2, when the bushing cap 12 is mounted to an existing transformer bushing 16, the stem 14 is first coupled to the energized end 20 of the bushing 16. A first disk 26 is then slidably placed over the stem 14 so that it rests on the flange of collar 24. The disk 26 is sized so that the central aperture thereof has a diameter greater that the diameter of the stem 14 but less than the outer diameter of the flange so that the disk 26 reliably sits upon the flange. Further, the outer diameter of disk 26 is sized so as to be greater than both the flange and the diameter of the mounting aperture 32 so that the disk can ensure the cap is securely mounted to the stem, as will become more apparent below.

Once the supporting disk 26 has been mounted to the stem 14, the cap 12 is mounted to the stem 14 so that the free end 22 of the stem passes through the mounting aperture 32, to a position where the closed end 30 of the cap rests upon the mounting disk 26 with the conical side walls 36 of the bushing cap disposed in surrounding relation to the bushing 16.

Once the transformer cap has been slidably received on the cap stem, a further disk 28 again preferably formed of metal or ceramic material is slidably received over the stem 14 so as to ensure sealing of the aperture 32 of the bushing cap. The cap 12 is then rigidly secured to the cap stem and the porcelain bushing by tightening one or more nuts 38 about the threaded end portion 22 of the stem. Thus, the transformer bushing cap 12 is fixedly mounted in surrounding relation to the bushing so as to prevent fluid leakage along the cap stem to the porcelain bushing and the cap acts much like an umbrella sheltering the bushing cap from airborne contaminants such as salt spray.

As shown in FIG. 2 the bushing cap is preferably sized so that and mounted to the bushing so that there is a clearance $\alpha$ between the bottommost edge of the cap and the tank as well as a clearance gap $\beta$ circumferentially of the bushing. In accordance with the most preferred embodiment, the clearance gap $\beta$ between the bushing cap and the bushing porcelain is at least about one and one half inches circumferentially of the porcelain bushing. Furthermore, the clearance $\alpha$ to the tank is preferably at least about three inches. While the clearance gaps $\alpha$, $\beta$ could obviously be varied, they are necessary to prevent a conductive coating which may form on the bushing cap from providing a direct or indirect conductive path to the metal transformer casing from the threaded end of the stem.

Figure 3:
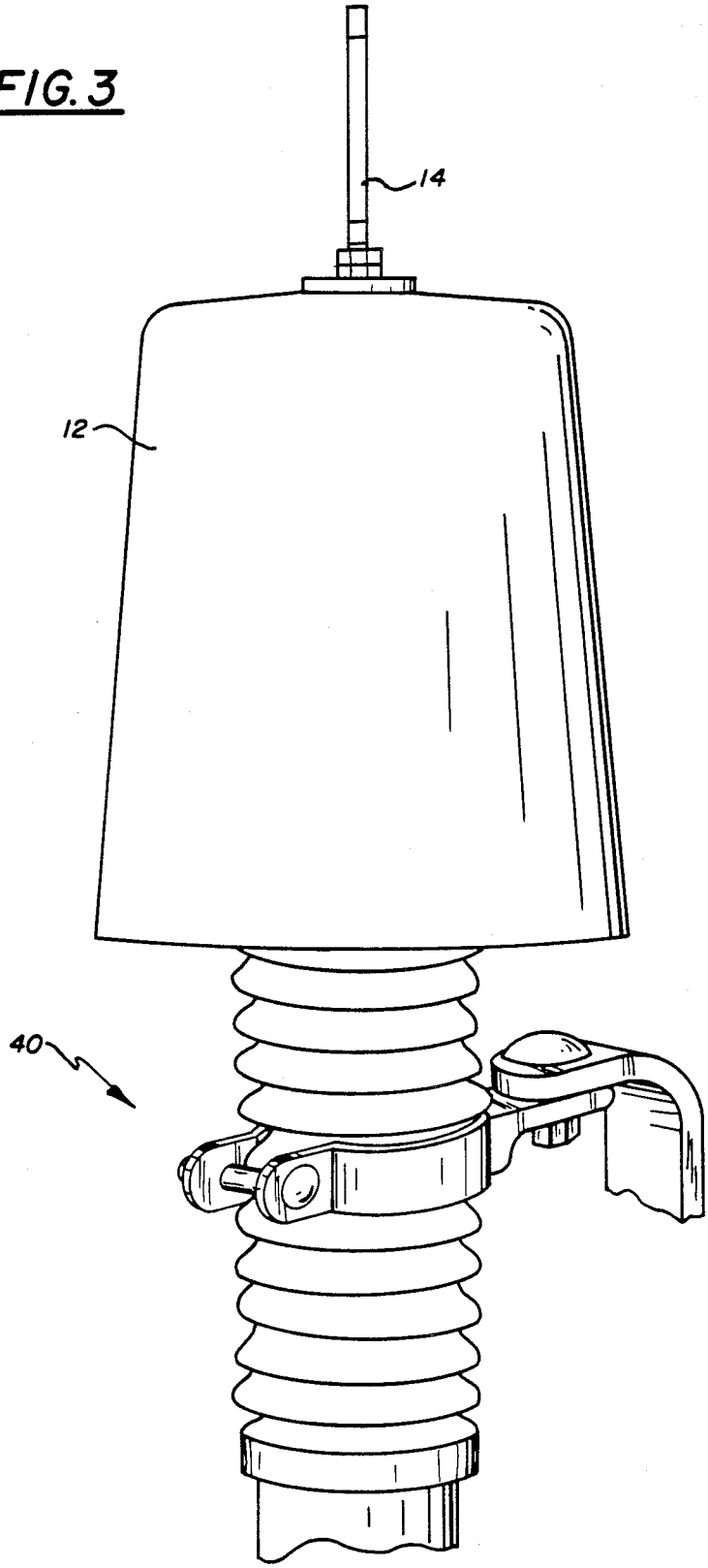
FIG. 3 is a side elevational view partly in cross-section showing a cap mounted to a lightening arrestor in accordance with the present invention.

Referring to FIG. 3, the bushing cap formed in accordance with the present invention can also be advantageously used to protect lightening arrestors 40 from the deposition of contaminants such as salt spray in a manner analogous to the transformer bushing 16 discussed with reference to FIGS. 1 and 2. The cap stem 14 is coupled to the uppermost end of a conductor (not shown) of the lightening arrestor 40. The sealing and supporting disks are likewise slidably received on the cap stem 14 and the cap 12 is mounted to the cap stem so as to depend downwardly in surrounding relation to a portion of the lightening arrestor. Again a clearance gap must be defined circumferentially of the porcelain bushing material and the bushing cap is disposed in surrounding relation to only a portion of the length of the insulative porcelain.

Figure 4:
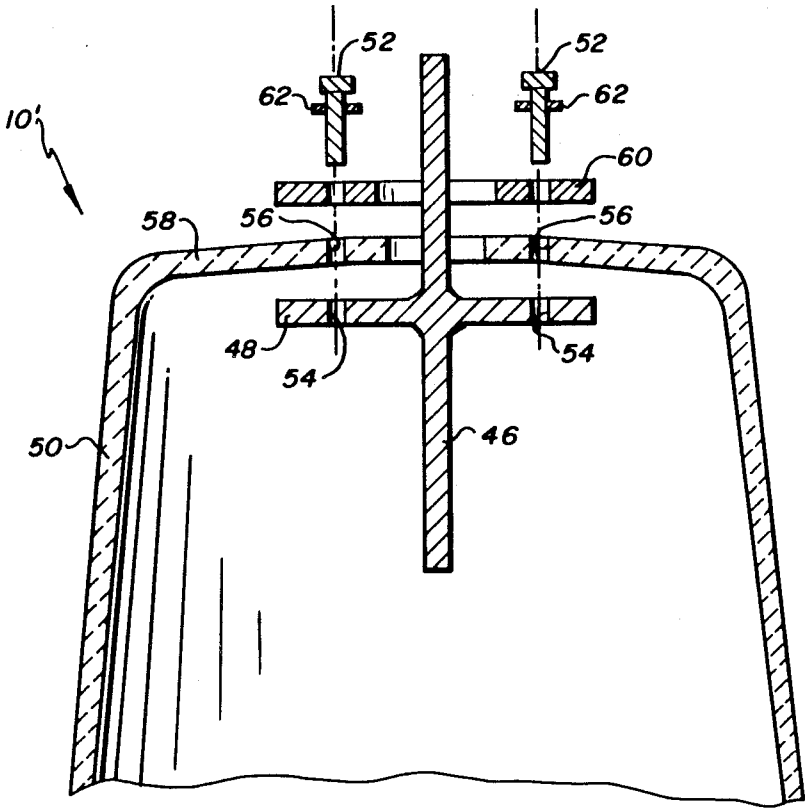
FIG. 4 is a exploded view showing an alternate cap structure in accordance with the present invention.

Referring to FIG. 4, an alternate embodiment of the bushing cap 10' formed in accordance with the present invention is shown. As can be seen, in this embodiment, the cap stem 46 includes a flange 48 of substantial dimensions which enables the supported mounting of the bushing cap 50 thereto without the need for support disks 26,28 as shown in FIGS. 1, 2 and 3. In this embodiment the cap 50 is rigidly coupled to the cap stem 46 and hence to the bushing by means of two or more bolts 52 inserted through apertures 54 defined in the flange 48 of the cap stem 46 and through corresponding apertures 56 in the top wall 58 of the bushing cap 50. A compression washer 60 is preferably disposed between the bolts 52 and the cap 50 and a lock washer 62 is preferably provided for each bolt 52 to ensure a secure coupling of the cap 50 to the stem 46. In this manner, rigid engagement of the bushing cap to the stem and hence to the bushing itself is ensured while the coupling process is quick and easy.

It will be appreciated, that the embodiment illustrated in FIGS. 1–3 is generally considered to be the most preferred embodiment as coupling directly to the cap stem requires fewer parts than separate bolts and nuts as illustrated in FIG. 4 and the securing of the various parts of the structure to the central, fixed cap stem can be more quickly and easily accomplished than the insertion of bolts and coupling of nuts through spaced apertures, as illustrated in FIG. 4. It is to be understood, however, that varying transformer bushing locations and whether the the structure is assembled prior to deposition in the field or is assembled on site will dictate the most preferred manner of coupling the cap to the transformer bushing or lightening arrestor While in the illustrated embodiment the cap stem is illustrated as having an end for insertion coupling to the energized end of the bushing, the particular coupling used for coupling the bushing stem to the bushing of course depend upon the particular bushing and the configuration of the energized end. Thus it is to be understood that the cap stem can be formed so as to be slidably or screw threadably received over a male bushing energized end or slidably or threadably inserted into a female bushing energized end. These and other coupling structures are, of course, functionally equivalent and thus the present invention is not deemed to reside in any particular coupling configuration.

While the invention has been described in connection with what is presently considered to be the most practical and preferred embodiment, it is to be understood that the invention is not limited to the disclosed embodiment, but, to the contrary, it is intended to cover various modifications and equivalent arrangements included within the spirit and scope of the appended claims.

What is claimed is:

1. A cap for an insulated bushing of an electrical conductor for protecting the bushing from airborne contaminants, comprising:

a non-conductive cap element having a closed end and an open end and a mounting aperture defined through said closed end;

a stem element having a longitudinal axis, a first end including means for coupling to an exposed end of the electrical conductor, said stem being received in said mounting aperture and being fixedly coupled to said cap element, said stem including a circumferential flange; and a sealing disk slidably mounted to said stem element and size to engage said flange element to provide a sealing coupling between said cap element and said stem.

2. A cap as in claim 1, wherein said cap element includes frustoconical sidewalls such that the sidewalls of said cap element have a minimum diameter adjacent said closed end a maximum diameter adjacent said open end.

3. A transformer having at least one insulated bushing surrounding an electrical conductor and including a bushing cap mounted to each said insulative bushing, each said cap comprising:

a non-conductive cap element having a closed end and an open end and a mounting aperture defined through said closed end;

a stem element having a longitudinal axis, a first end including means for coupling to an exposed end of the electrical conductor, said stem being received in said mounting aperture and being fixedly coupled to said cap element, stem including a circumferential flange; and a sealing disk slidably mounted to said stem element and sized to engage said flange element to provide a sealing coupling between said cap element and said stem.

4. A cap as in claim 3, wherein said cap element includes frustoconical sidewalls such that the sidewalls of said cap element have a minimum diameter adjacent said closed end a maximum diameter adjacent said open end.

5. A lightening arrestor having an electrical conductor encased in an insulated bushing and a cap mounted to one end thereof, said cap including:

a non-conductive cap element having a closed end and an open end and a mounting aperture defined through said closed end;

a stem element having a longitudinal axis, a first end including means for coupling to an exposed end of the electrical conductor, said stem being received in said aperture and being fixedly coupled to said cap element, stem including a circumferential flange; and a sealing disk slidably mounted to said stem element and sized to engage said flange element to provide a sealing coupling between said cap element and said stem.

6. A cap as in claim 5, wherein said cap element includes frustoconical sidewalls such that the sidewalls of said cap element have a minimum diameter adjacent said closed end a maximum diameter adjacent said open end.

7. A cap for an insulated bushing of an electrical conductor for protecting the bushing from airborne contaminants, comprising:

a non-conductive cap element having a closed end and an open end and a mounting aperture defined through said closed end;

a stem element having a longitudinal axis, a first end including means for coupling to an exposed end of the electrical conductor, said stem being received in said aperture and being fixedly coupled to said cap element, said stem further including a circumferential flange having a diameter greater that the diameter of said mounting aperture; and bolt means extending through and coupling said circumferential flange and said closed end of said cap element.

* * * * *